US009482463B2

(12) United States Patent
Choi et al.

(10) Patent No.: US 9,482,463 B2
(45) Date of Patent: Nov. 1, 2016

(54) REFRIGERATOR

(71) Applicant: SAMSUNG ELECTRONICS CO., LTD., Suwon-si, Gyeonggi-do (KR)

(72) Inventors: Sung Pil Choi, Gwangju (KR); Dong In Shin, Gwangju (KR); Hyo Seok Noh, Gwangju (KR); Young Kyu Moon, Gwnagju (KR); Mu Yeol Sun, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 19 days.

(21) Appl. No.: 14/476,220

(22) Filed: Sep. 3, 2014

(65) Prior Publication Data

US 2015/0137674 A1 May 21, 2015

(30) Foreign Application Priority Data

Nov. 18, 2013 (KR) ..... 10-2013-0139646

(51) Int. Cl.
*A47B 96/04* (2006.01)
*F25D 23/02* (2006.01)
(Continued)

(52) U.S. Cl.
CPC ..... *F25D 23/028* (2013.01); *E05B 65/0042* (2013.01); *E05C 7/02* (2013.01);
(Continued)

(58) Field of Classification Search
CPC ..... Y10T 292/1043; Y10T 292/1075; Y10T 292/1052; E05B 85/26; E05B 65/0042; E05C 3/12; E05C 7/02; E05C 7/06; E05C 7/002; E05C 3/24; E06B 5/11; Y10S 292/18; F25D 23/028
USPC ..... 292/194, 195, 219, 220, DIG. 37, 292/DIG. 71; 49/52, 53, 54, 61, 63, 65
See application file for complete search history.

(56) References Cited

U.S. PATENT DOCUMENTS 2,942,438 A * 6/1960 Schmeling ..... F25D 23/04 62/377
2,945,733 A * 7/1960 Malia ..... F25D 23/04 280/79.2

(Continued)

FOREIGN PATENT DOCUMENTS

| | | |
|---|---|---|
| JP | 2000-249462 | 9/2000 |
| JP | 2004-211977 | 7/2004 |
| KR | 10-2012-0063307 | 6/2012 |

OTHER PUBLICATIONS

International Search Report issued Mar. 18, 2015 in corresponding Application PCT/KR2014/011006.

*Primary Examiner* — Daniel J Troy
*Assistant Examiner* — Andres Gallego
(74) *Attorney, Agent, or Firm* — Staas & Halsey LLP

(57) ABSTRACT

A refrigerator may prevent an internal door from being opened together by an inertial force when an external door is opened, and may also prevent the external door from being opened together by an inertial force when the internal door is opened. The refrigerator includes a main body, a storage chamber provided in the main body so that a front surface thereof is opened, an internal door rotatably provided at a front surface of the main body so as to open and close the storage chamber and having an opening part in which a plurality of door guards are provided, an external door rotatably provided at a front surface of the internal door so as to open and close the opening part, and an internal door opening prevention device allowing or preventing opening of the internal door according to whether the external door is opened or closed.

14 Claims, 16 Drawing Sheets

(51) Int. Cl.

| | |
|---|---|
| ***E05B 65/00*** | (2006.01) |
| ***E05D 11/10*** | (2006.01) |
| ***F25D 23/06*** | (2006.01) |
| ***E05C 7/02*** | (2006.01) |
| *E05B 85/26* | (2014.01) |
| *F25D 23/04* | (2006.01) |
| *E05D 7/081* | (2006.01) |

(52) U.S. Cl.

CPC ..... *E05D 11/10* (2013.01); *F25D 23/062* (2013.01); *E05B 85/26* (2013.01); *E05D 7/081* (2013.01); *E05Y 2900/31* (2013.01); *F25D 23/04* (2013.01); *Y10T 292/1043* (2015.04)

(56) References Cited

U.S. PATENT DOCUMENTS

| | | | | |
|---|---|---|---|---|
| 3,086,830 | A * | 4/1963 | Malia | F25D 23/04 292/31 |
| 4,302,907 | A * | 12/1981 | Canals | E05C 7/02 292/150 |
| 2013/0026900 | A1 | 1/2013 | Oh et al. | |
| 2013/0049562 | A1 * | 2/2013 | Jung | F25D 23/028 312/405 |
| 2013/0170897 | A1 | 7/2013 | Kang et al. | |

* cited by examiner

REFRIGERATOR

CROSS-REFERENCE TO RELATED APPLICATIONS

This application claims the benefit of Korean Patent Application No. 10-2013-0139646, filed on Nov. 18, 2013 in the Korean Intellectual Property Office, the disclosure of which is incorporated herein by reference.

BACKGROUND

1. Field

One or more embodiments relate to a refrigerator which has an internal door rotatably disposed at a main body so as to open and close a storage chamber and having an opening part, and an external door rotatably disposed at the internal door so as to open and close the opening part.

2. Description of the Related Art

In general, a refrigerator is a home appliance which has a storage chamber storing food and a cold air supplying device supplying cold air to the storage chamber so as to keep the food fresh for a long time.

A shelf on which to put the food is provided at the storage chamber, and the storage chamber has an opened front surface through which to store and take out the food.

The opened front surface of the storage chamber may be opened and closed by an internal door which is rotatably coupled to a main body, and the internal door has an opening part.

The opening part formed in the internal door may be opened and closed by an external door which is rotatably coupled to the internal door.

Gaskets are provided at each rear surface of the internal door and the external door in order to maintain airtightness between the internal door and the main body and between the internal door and the external door. When the external door is excessively opened, or an opening and closing speed of the external door is too fast, the internal door may be opened together by an inertial force of the external door.

Further, when the internal door is opened, the external door may be undesirably opened by the inertial force.

SUMMARY

The foregoing described problems may be overcome and/or other aspects may be achieved by one or more embodiments of a refrigerator which prevents an internal door from being opened by inertial force when an external door is opened.

Further, the foregoing described problems may be overcome and/or other aspects may be achieved by one or more embodiments of a refrigerator which prevents the external door from being opened by the inertial force when the internal door is opened.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a refrigerator may include a main body, a storage chamber provided in the main body so that a front surface thereof is opened, an internal door rotatably provided at a front surface of the main body so as to open and close the storage chamber and having an opening part in which a plurality of door guards are provided, an external door rotatably provided at a front surface of the internal door so as to open and close the opening part, and an internal door opening prevention device allowing or preventing opening of the internal door according to whether the external door is opened or closed.

The internal door opening prevention device may allow the internal door to be opened when the external door is closed, and may prevent the internal door from being opened when the external door is opened.

The internal door opening prevention device may include a stopper coupled to a lower portion of the main body, a locking part rotatably coupled to a lower portion of the internal door and rotated according to whether the external door is opened or closed so as to be locked and unlocked with the stopper, a spring configured to elastically support the locking part, and a cover configured to cover the locking part so as to prevent the locking part from being exposed to an outside and having a rotational protrusion to which the locking part is rotatably coupled.

The stopper and the cover may be respectively coupled to the lower portion of the main body and the lower portion of the internal door by fastening members.

A protruding part may be coupled to a lower portion of the external door so as to be in contact with the locking part and thus to rotate the locking part when the external door is closed.

The locking part may be rotatably coupled to the lower portion of the internal door by the rotational protrusion, and may include a rotational hole into which the rotational protrusion may be inserted, a contact portion which may be in contact with the protruding part, a locking hook which may be rotated according to whether the external door is opened or closed and locked and unlocked with the stopper, and a spring coupling portion to which the spring may be coupled.

The stopper may include a hook which may have a shape corresponding to the locking hook so that the locking hook may be locked and unlocked.

Parts of front and rear surfaces of the cover may be opened so that the locking part may be rotated forward and backward around the rotational protrusion, and the cover may include a spring supporting portion that may support one end of the spring, the other end of which may be coupled to the spring coupling portion.

When the external door is closed, the protruding part may be in contact with the contact part so that the locking part may be rotated around the rotational protrusion by the spring in a counterclockwise direction, and if the locking part is rotated around the rotational protrusion in the counterclockwise direction, and the locking hook is unlocked with the stopper, the internal door may be allowed to be opened.

When the external door is opened, the protruding part may be released from contact with the contact part, and the locking part may be rotated around the rotational protrusion in a clockwise direction, and if the locking part is rotated around the rotational protrusion in the clockwise direction, and the locking hook is locked with the stopper, the internal door may be prevented from being opened.

In accordance with one or more embodiments, a refrigerator may include a main body having a storage chamber, an internal door rotatably provided at a front surface of the main body so as to open and close the storage chamber and having an opening part in which a plurality of door guards may be provided, an external door rotatably provided at a front surface of the internal door so as to open and close the opening part, and an internal door opening prevention device allowing or preventing opening of the internal door according to whether the external door is opened or closed, wherein the internal door opening prevention device may include a stopper coupled to a lower portion of the main body, a locking part rotatably coupled to a lower portion of the internal door and rotated according to whether the external door is opened or closed so as to be locked and unlocked with the stopper, and a spring coupled to the locking part and rotating the locking part so that the locking part may be locked with the stopper when the external door is opened.

The internal door opening prevention device may be coupled to the lower portion of the internal door so as to prevent the locking part from being exposed to an outside, and may further include a cover having a rotational protrusion to which the locking part may be rotatably coupled.

A protruding part may be provided at a lower portion of the external door so as to be in contact with the locking part and thus to rotate the locking part when the external door is closed.

The locking part may be rotatably coupled to the lower portion of the internal door by the rotational protrusion, and may include a rotational hole into which the rotational protrusion may be inserted, a contact portion which may be in contact with the protruding part, a locking hook which is rotated according to whether the external door is opened or closed and locked and unlocked with the stopper, and a spring coupling portion to which the spring may be coupled.

The stopper may include a hook which may have a shape corresponding to the locking hook so that the locking hook may be locked and unlocked.

Parts of front and rear surfaces of the cover may be opened so that the locking part may be rotated forward and backward around the rotational protrusion, and the cover may include a spring supporting portion supporting one end of the spring, the other end of which may be coupled to the spring coupling portion.

The stopper and the cover may be respectively coupled to the lower portion of the main body and the lower portion of the internal door by fastening members.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
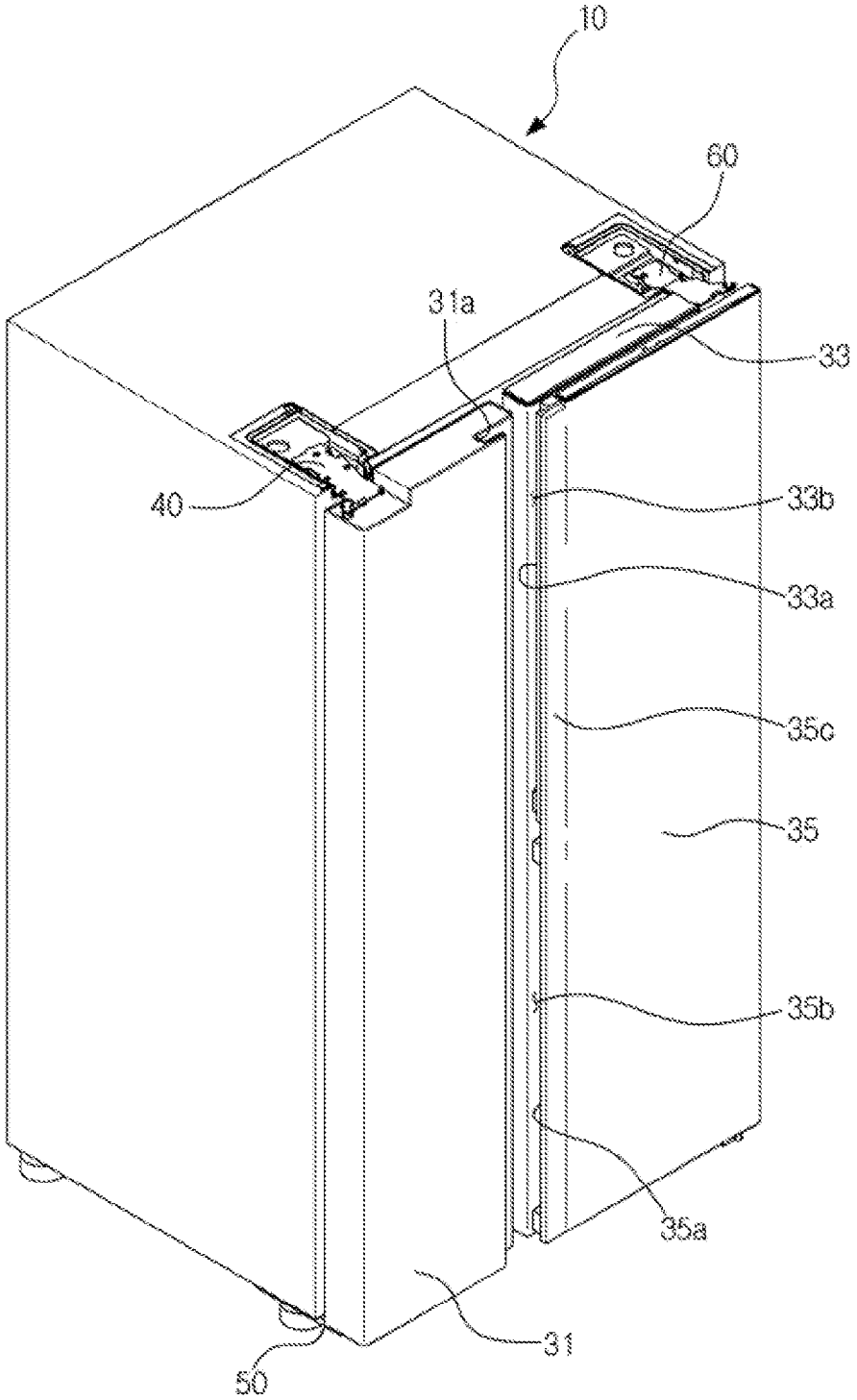
FIG. 1 is a view illustrating a refrigerator in accordance with one or more embodiment, wherein both an internal door and an external door are closed.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

As illustrated in FIGS. 1 to 4, a refrigerator may include a main body 10, a storage chamber 20 which may be provided in the main body 10 so that a front surface thereof may be opened, a door 30 which may open and close the storage chamber 20, and a cold air supplying device which may supply cold air to the storage chamber 20.

The main body 10 may have approximately a box shape, and may include an inner case 11 which may form the storage chamber 20, an outer case 13 which may be coupled to an outer side of the inner case 11 and may form an exterior, and an insulation material (not shown) which may be provided between the inner case 11 and the outer case 13.

The inner case 11 may be formed, for example, of a resin material, and the outer case 13 may be formed, for example, of a steel material.

The cold air supplying device may include a compressor (not shown), a condenser (not shown), an expansion valve (not shown) and an evaporator (not shown), and may circulate a refrigerant and produce cold air using evaporative latent heat.

The storage chamber 20 may be partitioned, for example, into a left freezer 21 and a right refrigeration chamber 23 by a vertical partition wall 15.

However, positions of the freezer 21 and the refrigeration chamber 23 may be switched, and the refrigeration chamber 23 may have a shelf 25 on which food may be put.

The storage chamber 20 of which the front surface may be opened may be opened and closed by the door 30. The door 30 may include a freezer door 31 and a refrigeration chamber door 33 which may open and close the freezer 21 and the refrigeration chamber 23, respectively.

The freezer door 31 may be rotatably disposed at a front side of the main body 10, and may be provided to be rotated leftward and rightward about a vertical rotational shaft.

The freezer door 31 may be rotatably supported by an upper hinge 40 and a lower hinge 50 which may be respectively coupled to an upper surface and a lower surface of the main body 10.

The refrigeration chamber door 33 may also be rotatably disposed at the front side of the main body 10, and may be provided to be rotated leftward and rightward about a vertical rotational shaft.

The refrigeration chamber door 33 may have an opening part 33*c* formed to have a slightly smaller size than the refrigeration chamber 23, and a plurality of door guards 37 may be provided at the opening part 33*c*.

The opening part 33*c* provided at the refrigeration chamber door 33 may be opened and closed by the external door 35. For convenience of explanation, the refrigeration chamber door 33 is referred to as an internal door.

The internal door 33 may be rotatably supported by a first upper hinge 60 and a first lower hinge 80 which may be respectively coupled to the upper surface and the lower surface of the main body 10.

The external door 35 may be rotatably disposed at a front side of the internal door 33, and may be provided so as to be rotated in the same rotational direction as that of the internal door 33.

Rotational shafts of the internal door 33 and the external door 35 may be parallel with each other, but may not be coaxial.

The external door 35 may be rotatably supported by a second upper hinge 70 and a second lower hinge 90 which may be respectively coupled to an upper surface and a lower surface of the internal door 33.

A handle 31*a* may be provided at the freezer door 31 in order to allow a user to grasp the handle 31*a* and then open and close the freezer door 31.

A first handle 33*a* and a second handle 35*a* may also be provided at the internal and external doors 33 and 35, respectively. The first and second handles 33*a* and 35*a* may be provided to be parallel with each other in a roughly vertical direction and the first handle 33*a* may be provided above the second handle 35*a*.

Further, the first and second handles 33*a* and 35*a* may have first and second receiving grooves 33*b* and 35*b* which may receive a user's hand.

The first and second receiving grooves 33*b* and 35*b* may also be provided to be parallel with each other in the roughly vertical direction. The first receiving groove 33*b* may be disposed over the second receiving groove 35*b*.

The user may put his/her hand into the first receiving groove 33*b* and grasp the first handle 33*a*, and may also put his/her hand into the second receiving groove 35*b* and grasp the second handle 35*a*.

At this time, a handle cover 35*c* may be formed to extend to an upper side of the second handle 35*a* and thus may cover the first handle 33*a*.

Therefore, when seen from a front side, the first handle 33*a* may be covered by the handle cover 35*c* and thus may not be exposed.

The external door 35 may not have the opening part, and may have a roughly flat plate shape so as to open and close the opening part 33*c* of the internal door 33.

In operations of the internal and external doors 33 and 35, as illustrated in FIG. 1, when internal and external doors 33 and 35 are closed, the refrigeration chamber 23 may be airtightly sealed, and thus the cold air in the refrigeration chamber 23 may be preserved.

Figure 2:
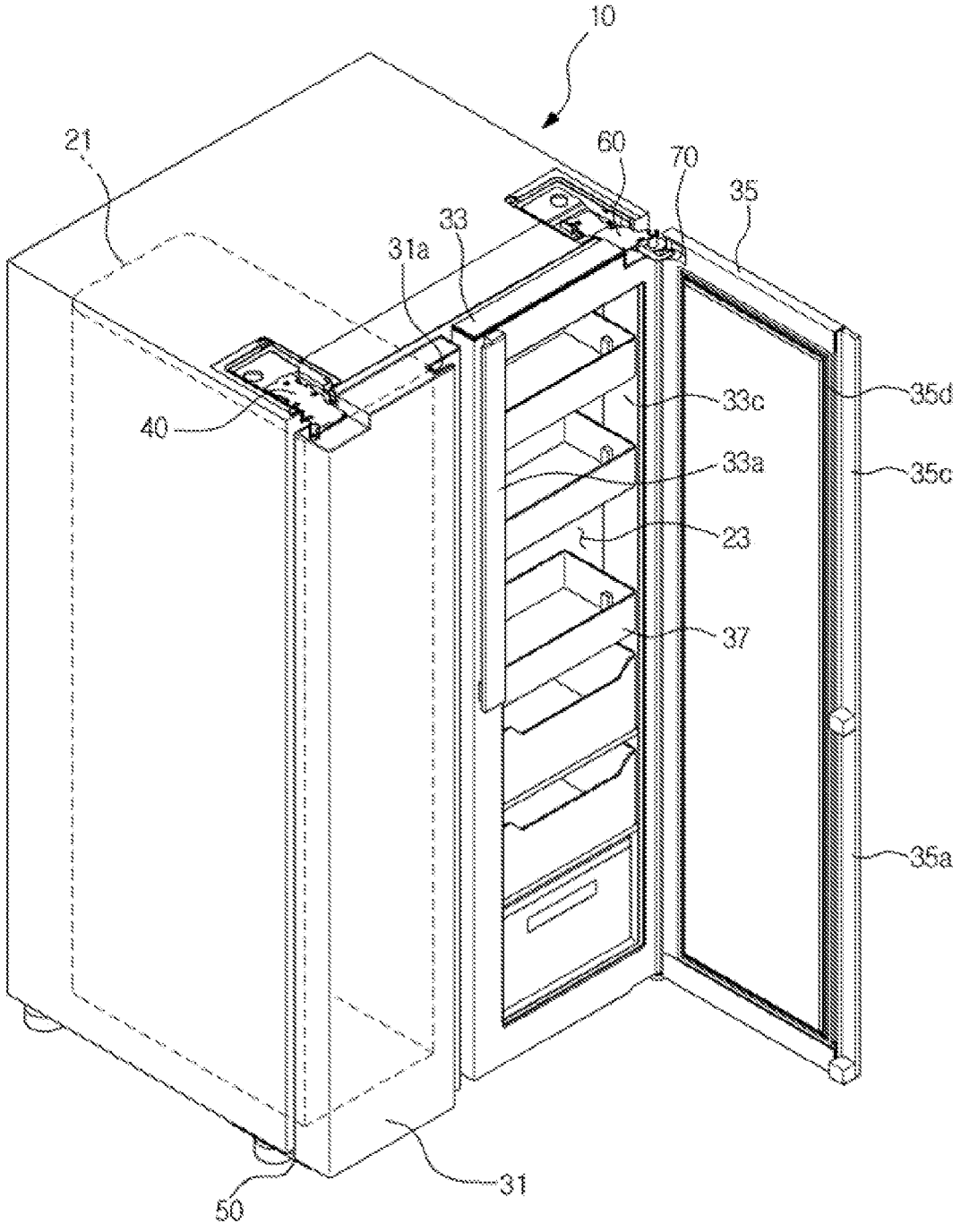
FIG. 2 is a view illustrating a state in which an external door of a refrigerator in accordance with one or more embodiment, such as the refrigerator of FIG. 1 is opened.

As illustrated in FIG. 2, when the external door 35 is opened, the user may approach at least one door guard 37 and then may store and remove food in and from the at least one door guard 37.

At this time, leakage of the cold air from the refrigeration chamber 23 may be reduced, compared with a state in which the internal door 33 is opened.

Figure 3:
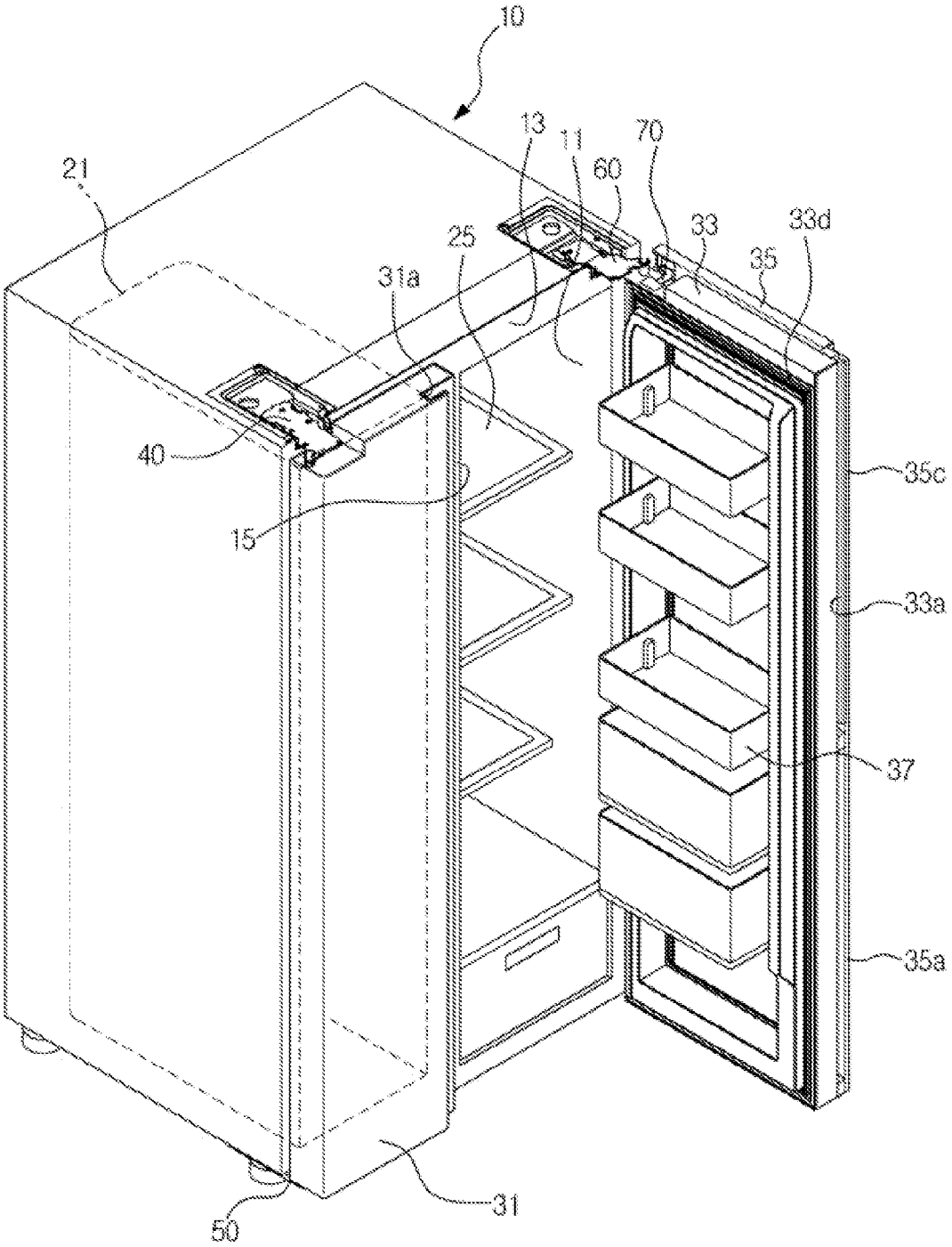
FIG. 3 is a view illustrating a state in which an internal door of a refrigerator in accordance with one or more embodiment, such as the refrigerator of FIG. 1 is opened.
Figure 4:
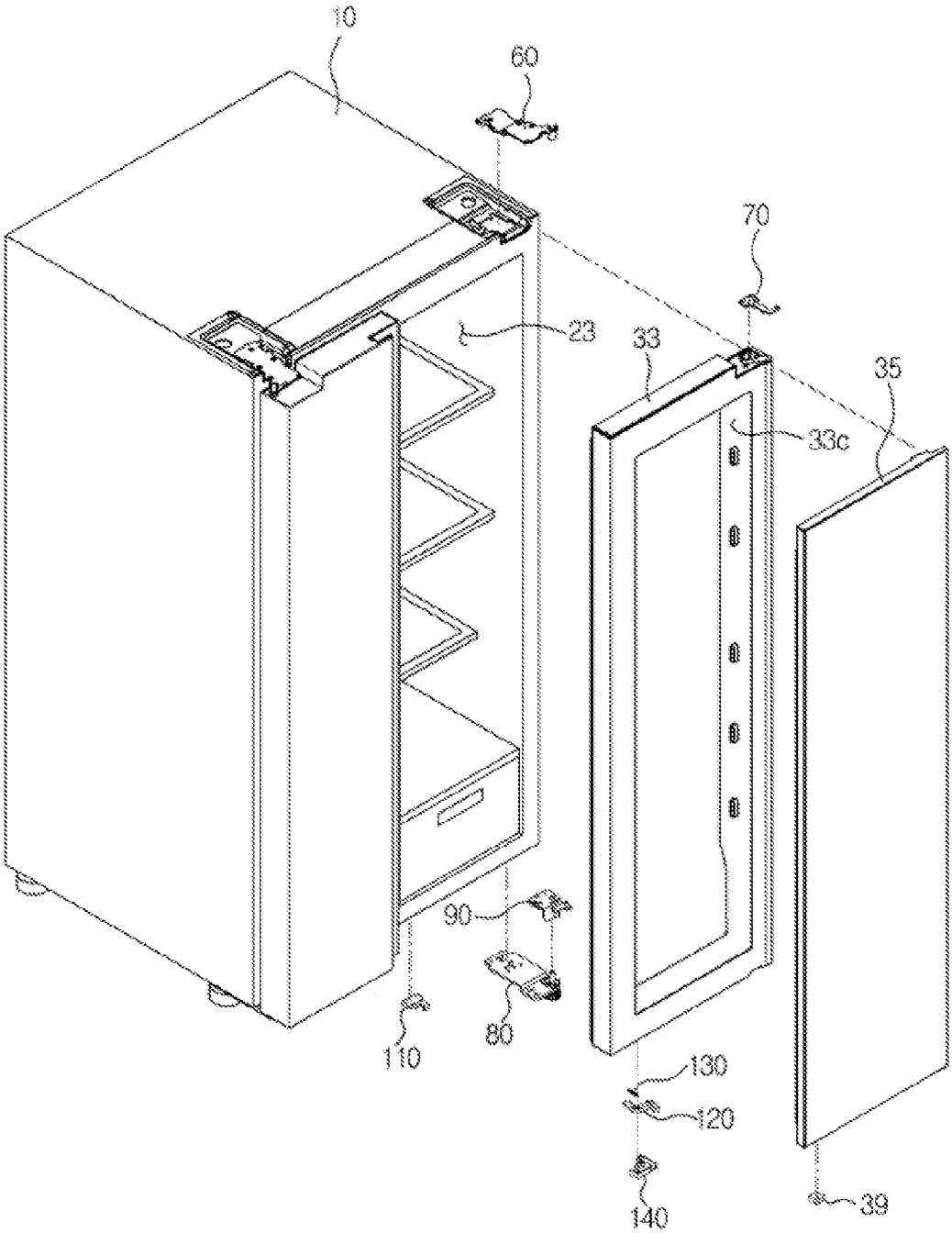
FIG. 4 is a view illustrating a state in which external and internal doors of a refrigerator in accordance with one or more embodiment, such as the refrigerator of FIG. 1 are separated from each other.

As illustrated in FIG. 3, when the internal door 33 is opened, the user may access an inside of the refrigeration chamber 23 and then store and remove food on and from the shelf 25, and may also access the at least one door guard 37 and then store and remove food in and from the at least one door guard 37.

As described above, in the refrigerator according to one or more embodiment, the food may be stored and removed, as necessary, in various manners, and the leakage of the cold air may be minimized.

Meanwhile, a first gasket 33*d* may be provided at a rear surface of the internal door 33 so as to possibly maintain an airtight seal between the internal door 33 and the outer case 13 of the main body 10. The first gasket 33*d* may be formed, for example, of a rubber material.

Further, the first gasket 33*d* may include a first magnet (not shown) so as to attract the outer case 13 formed of the steel material and thus to possibly maintain a closed state of the internal door 33.

Further, a second gasket 35*d* may be provided at a rear surface of the external door 35 so as to possibly maintain an airtight seal between the external door 35 and the internal door 33. The second gasket 35*d* may be formed, for example, of a rubber material.

Further, the second gasket 35*d* may include a second magnet (not shown) so as to attract a front surface of the internal door 33 formed of the steel material and thus to possibly maintain a closed state of the external door 35.

As described above, in the refrigerator according to one or more embodiment, the internal and external doors 33 and 35 may be normally maintained in the closed state by magnetic force of the magnets.

Particularly, in order to prevent the internal door 33 from being opened together when the external door 35 is opened, the magnetic force of the first magnet (not shown) of the internal door 33, which attracts the outer case 13 of the main body 10, should be greater than that of the second magnet (not shown) of the external door 35, which attracts the internal door 33.

Therefore, when the user pulls the external door 35 by applying force which is greater than the magnetic force of the second magnet (not shown) of the external door 35, which attracts the internal door 33, the external door 35 may be opened, while the internal door 33 is in the closed state.

However, when the external door 35 is excessively opened, or an opening and closing speed of the external door 35 is too fast, the internal door 33 may be opened together by inertial force of the external door 35.

That is, when the user grasps the second handle 35*a* and opens the external door 35, the external door 35 is sufficiently opened and then stopped. At this time, if the rotational inertial force is greater than the magnetic force of the first magnet (not shown) of the internal door 33, which attracts the outer case 13 of the main body 10, the internal door 33 may be undesirably opened.

This is because the internal and external doors 33 and 35 may have the same rotational direction and the external door 35 may be connected to the internal door 33 through the second upper hinge 70 and the second lower hinge 90.

In order to prevent the internal door 33 from being opened together by the inertial force of the external door 35, a refrigerator according to one or more embodiment further may include an internal door opening prevention device 100 which may prevent the internal door 33 from being undesirably opened by the inertial force when the external door 35 is opened.

Figure 5:
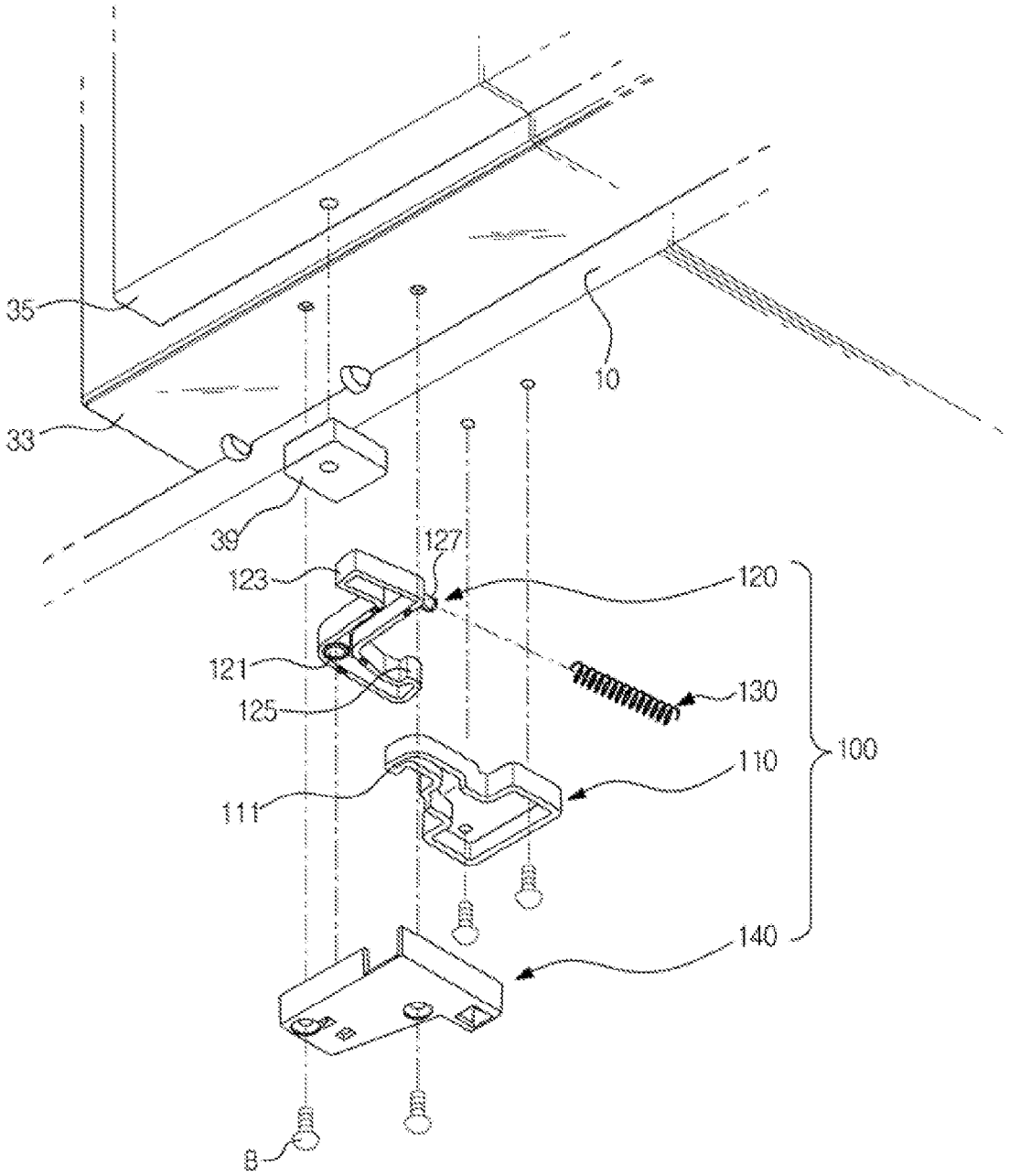
FIG. 5 is a view illustrating a state in which an internal door opening prevention device is being coupled to a refrigerator in accordance with one or more embodiment.
Figure 6:
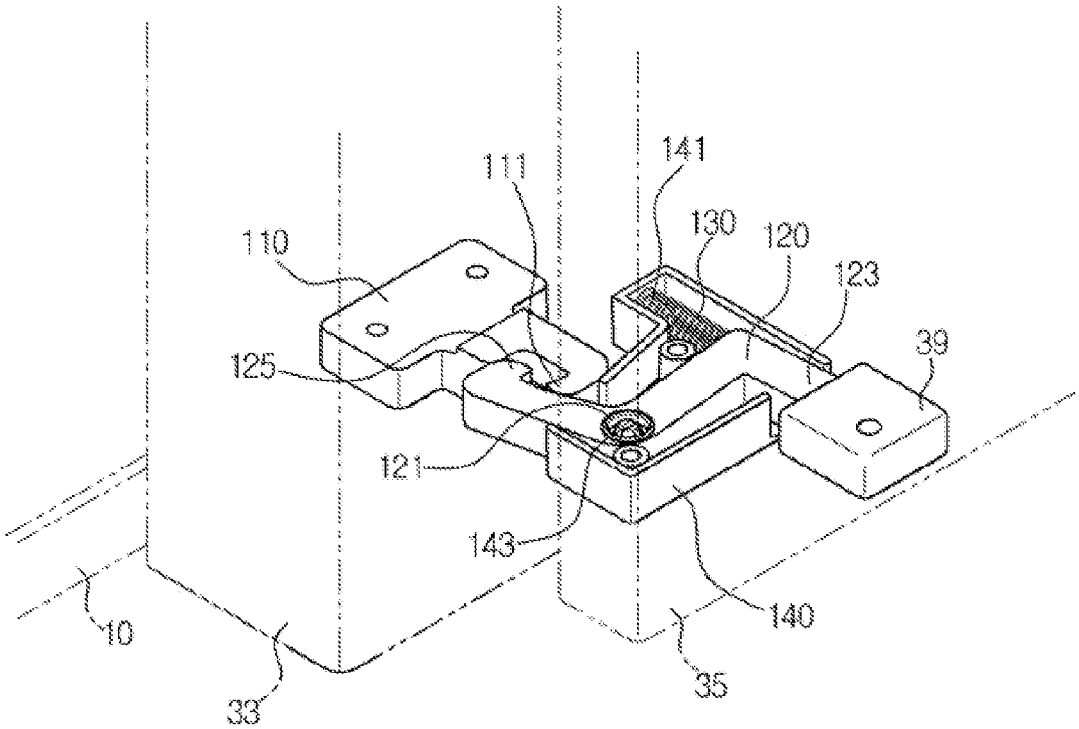
FIG. 6 is a view illustrating a state in which an internal door opening prevention device is coupled to a refrigerator in accordance with one or more embodiment.

As illustrated in FIGS. 5 and 6, the internal door opening prevention device 100 may include a stopper 110 which may be coupled to a lower portion of the main body 10, a locking part 120 which may be rotatably coupled to a lower portion of the internal door 33, a spring 130 which may elastically support the locking part 120, and a cover 140 which may cover the locking part 120 so that the locking part 120 is not exposed to an outside.

The stopper 110 may be coupled to the lower portion of the main body 10 by a fastening member B, and may include a hook 111 which may have a shape corresponding to a locking hook 125 of the locking part 120, which will be described later, so as to be locked or unlocked with the locking hook 125.

The locking part 120 may be rotatably coupled to the lower portion of the internal door 33 by a rotational protrusion 143 that may be provided at the cover 140, which will be described later, and may include a rotational hole 121 into which the rotational protrusion 143 may be inserted, a contact portion 123 which may be in contact with a protruding part 39 that may be coupled to the external door 35, the locking hook 125 which may be rotated according to whether the external door 35 is opened or closed and locked or unlocked with the stopper 110, and a spring coupling portion 127 to which the spring 130 may be coupled.

The locking part 120 which may be rotatably coupled to the lower portion of the internal door 33 may be disposed so that the contact portion 123 may be directed to the external door 35 and the locking hook 125 may be directed to the main body 10.

The protruding part 39 may be coupled to the lower portion of the external door 35 so as to be in contact with the contact portion 123 when the external door 35 is closed, and thus to rotate the locking part 120. Therefore, if the external door 35 is closed, the protruding part 39 may push the contact portion 123, and thus the locking part 120 may be rotated around the rotational protrusion 143 in a counterclockwise direction.

The locking hook 125 may be provided to have a shape corresponding to the hook 111 of the stopper 110, and may be locked or unlocked with the hook 111 according to whether the external door 35 is opened or closed.

The spring 130 may be coupled to the spring coupling portion 127 so as to rotate the locking part 120 around the rotational protrusion 143 in a clockwise direction when the external door 35 is opened and contact between the protruding part 39 and the contact portion 123 is released.

One end of the spring 130 may be coupled to the spring coupling portion 127 of the locking part 120, and the other end may be supported by a spring supporting part 141 of the cover 140, which will be described later.

When the external door 35 is closed, the spring 130 may be compressed by the locking part 120 which may be rotated around the rotational protrusion 143 in the counterclockwise direction by the protruding part 39 of the external door 35, and thus a compressed force may be stored. When the external door 35 is opened, the spring 130 may rotate the locking part 120, which may be released from the contact with the protruding part 39, around the rotational protrusion 143 in the clockwise direction using the compressed force.

The cover 140 may be coupled to the lower portion of the internal door 33 by the fastening member B so as to cover the locking part 120, such that the locking part 120 may not be exposed to the outside.

The cover 140 may include the spring supporting part 141 which may support the other end of the spring 130, and the rotational protrusion 143 to which the locking part 120 may be rotatably coupled. Parts of front and rear surfaces of the cover 140 may be opened so that the locking part 120 may be rotated forward and backward around the rotational protrusion 143.

An operation of the internal door opening prevention device which allows or prevents opening of the internal door according to whether the external door is opened or closed will be described with reference to FIGS. 7 to 9.

Figure 7:
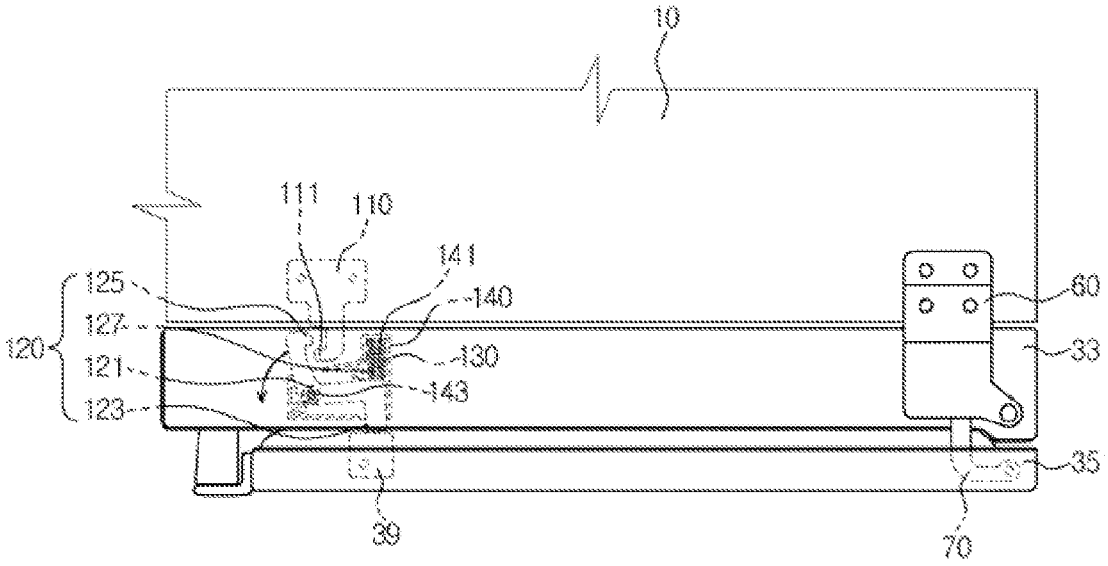
FIG. 7 is a view illustrating a state in which an external door of a refrigerator is closed in accordance with one or more embodiment.

As illustrated in FIG. 7, when the external door 35 is closed, the protruding part 39 provided at the external door 35 may be in contact with the contact portion 123 of the locking part 120 and may push the contact portion 123.

If the protruding part 39 pushes the contact portion 123, the locking part 120 may be rotated around the rotational protrusion 143 in the counterclockwise direction, and the locking hook 125 may be unlocked with the hook 111 of the stopper 110.

At this time, since the locking part 120 may be rotated around the rotational protrusion 143 in the counterclockwise direction, the spring 130 may be compressed by the locking part 120, and the compressed force may be stored.

Figure 8:
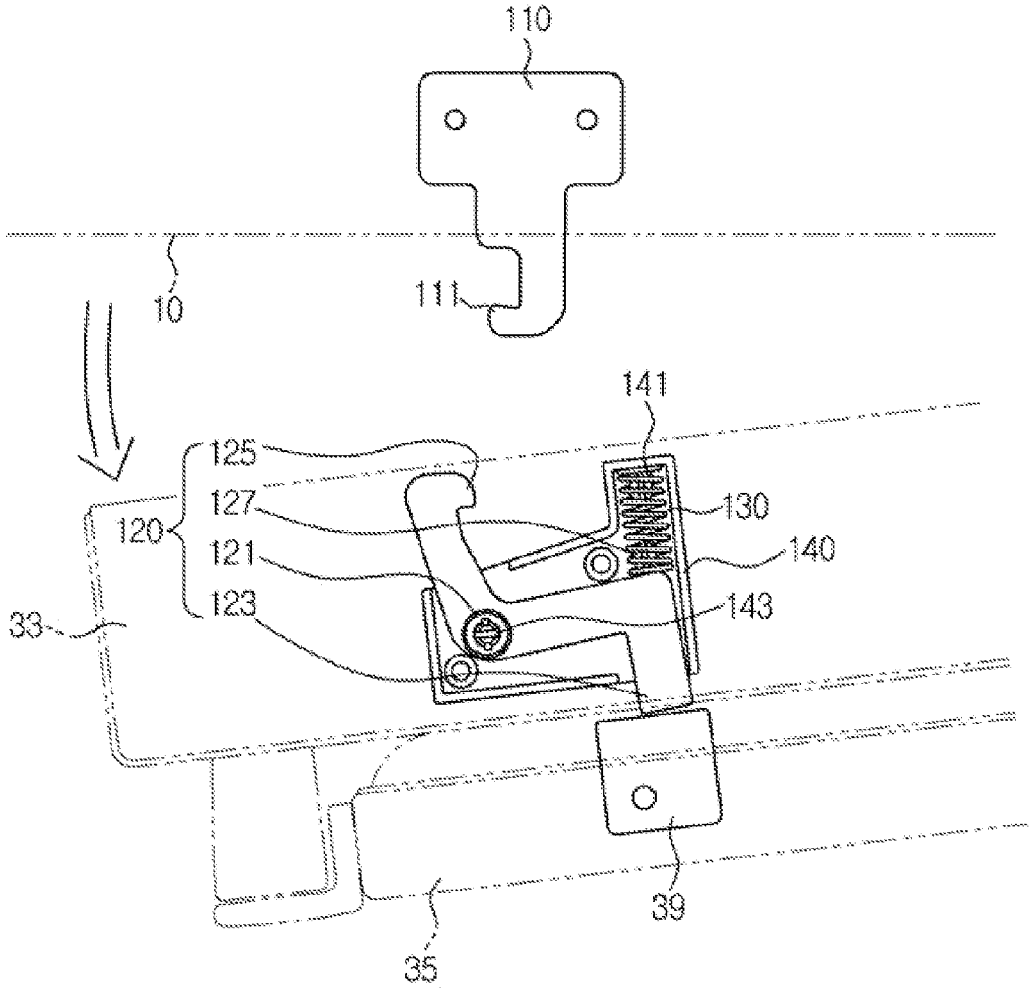
FIG. 8 is a view illustrating a state in which an internal door is being opened while the external door of a refrigerator is closed in accordance with one or more embodiment.

If the locking hook 125 is unlocked with the hook 111, the internal door 33 may be in a state in which it may be freely rotated from the main body 10, and thus the internal door 33 may be opened, as illustrated in FIG. 8.

Figure 9:
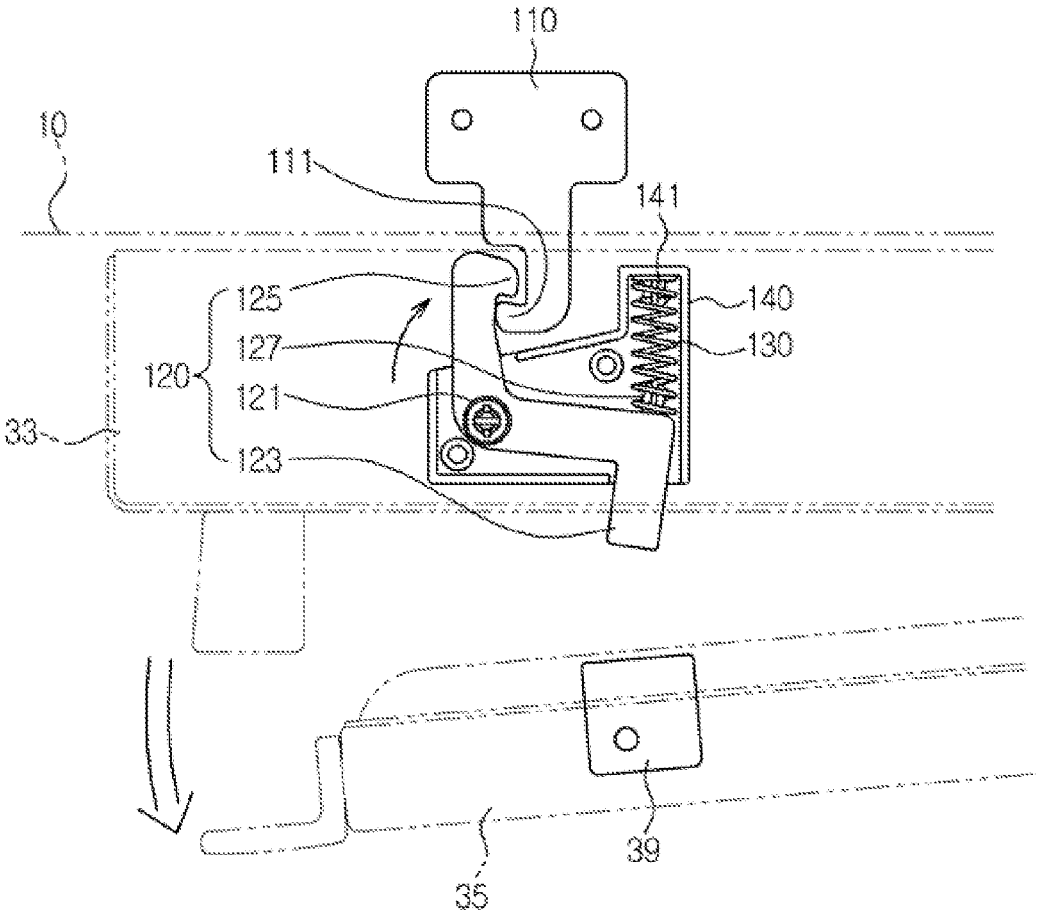
FIG. 9 is a view illustrating a state in which an external door of the refrigerator is opened in accordance with one or more embodiment.
Figure 10:
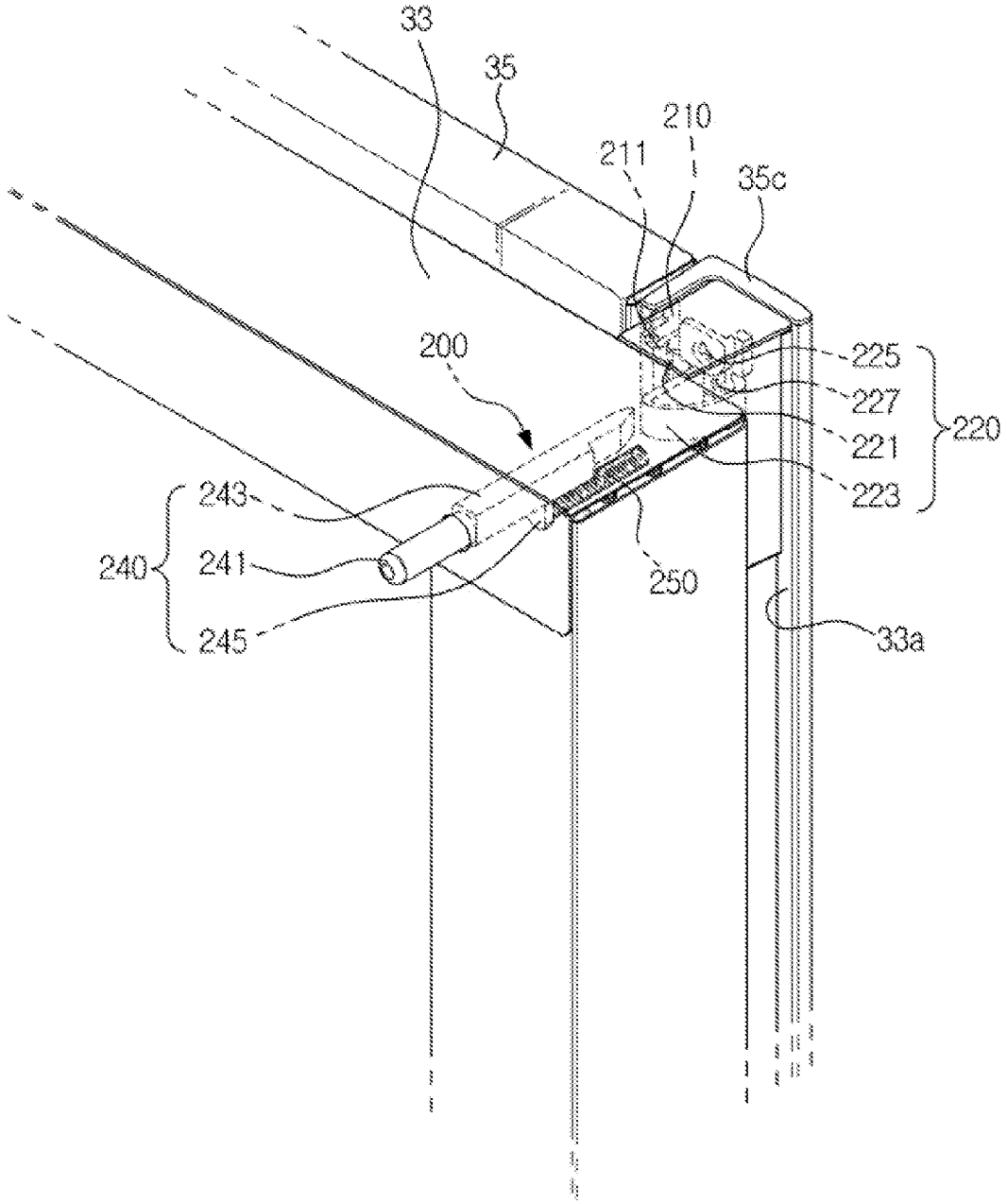
FIG. 10 is a view illustrating a state in which an external door opening prevention device is coupled to a refrigerator in accordance with one or more embodiment.
Figure 11:
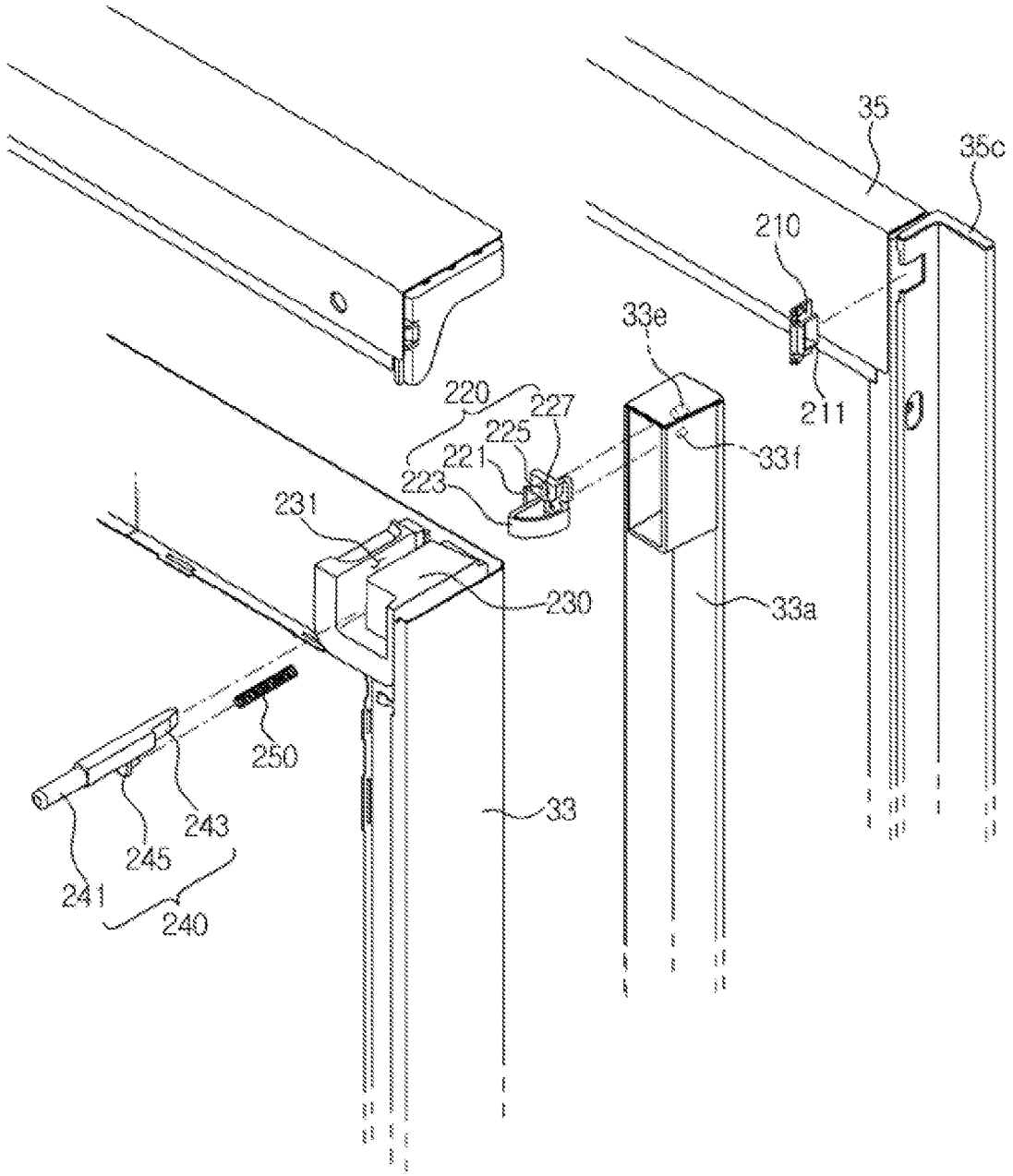
FIG. 11 is an exploded view illustrating a state in which an external door opening prevention device is being coupled to a refrigerator in accordance with one or more embodiment.

As illustrated in FIG. 9, if the external door 35 is opened, the protruding part 39 provided at the external door 35 may be released from the contact with the contact portion 123 of the locking part 120, and the locking part 120 may be rotated around the rotational protrusion 143 in the clockwise direction by the compressed force of the spring 130.

If the locking part 120 is rotated around the rotational protrusion 143 in the clockwise direction, the locking hook 125 may be in a locked state with the hook 111 of the stopper 110.

If the locking hook 125 is in the locked state with the hook 111, the internal door 33 may be locked with the main body 10, and thus the internal door 33 may not be opened, even when the external door 35 is opened.

As described above, when the external door 35 is closed, the internal door opening prevention device 100 may enable the internal door 33 to be freely rotated from the main body 10 and thus ma allow the internal door 33 to be opened. When the external door 35 is opened, the internal door opening prevention device 100 may enable the internal door 33 not to be freely rotated from the main body 10 and thus may prevent the internal door 33 from being opened.

Therefore, even if the external door 35 is excessively opened, or the opening and closing speed of the external door 35 is too fast, the internal door 33 may be prevented from being opened together by the inertial force of the external door 35.

Meanwhile, the refrigerator according to one r more embodiment may further include an external door opening prevention device 200 which may prevent the external door 35 from being undesirably opened by the inertial force when the internal door 33 is opened.

That is, in the same manner as when the user grasps the second handle 35*a* and opens the external door 35, if the user grasps the first handle 33*a* and opens the internal door 33, the internal door 33 may be sufficiently opened and then stopped. At this time, if the rotational inertial force is greater than the magnetic force of the second magnet (not shown) of the external door 35, which attracts the internal door 33, the external door 35 may be undesirably opened.

This is because the internal and external doors 33 and 35 have the same rotational direction and the external door 35 may be connected to the internal door 33 through the second upper hinge 70 and the second lower hinge 90.

As illustrated in FIGS. 10 to 13, the external door opening prevention device 200 may be coupled to an upper portion of the internal door 33, and may include a stopper 210 which may be coupled to an upper portion of the handle cover 35*c* that may be disposed at the upper portion of the second handle 35*a* of the external door 35, a locking part 220 which may be coupled to an upper portion of the first handle 33*a* of the internal door 33, a housing 230 which may be built in the upper portion of the internal door 33, an operation bar 240 which may be received in the housing 230 so as to be linearly moved forward and backward, and a spring 250 which may elastically support the operation bar 240.

The stopper 210 may be coupled to the upper portion of the handle cover 35*c* that may be disposed at the upper portion of the second handle 35*a* of the external door 35, and may include a hooking portion 211 which may be locked or unlocked with the locking part 220.

The locking part 220 is coupled to the upper portion of the first handle 33*a* of the internal door 33, and may include a locking hook 221 which may be locked or unlocked with the hooking portion 211 of the stopper 210, an elastic portion 223 which may be elastically deformed by a linear movement of the operation bar 240, and first and second coupling holes 225 and 227 into which first and second coupling protrusions 33*e* and 33*f* that may be provided at the first handle 33*a* of the internal door 33 may be respectively inserted.

The elastic portion 223 may be provided to be elastically deformed left and right by the operation bar 240, and the locking hook 221 may be provided at one side of the elastic portion 223 so as to be locked or unlocked with the hooking portion 211.

The first handle 33*a* may have a through-hole 33*g* through which the locking hook 221 may pass, such that the locking hook 221 may be locked or unlocked with the hooking portion 211.

The housing 230 may be built in the upper portion of the internal door 33, and may include a receiving groove 231 in which the operation bar 240 may be received to be linearly moved forward and backward, and a spring supporting portion 233 which may support the spring 250.

The operation bar 240 may be received in the receiving groove 231 of the housing 230 so as to be linearly moved forward and backward according to whether the internal door 33 is opened or closed.

The operation bar 240 may include a head portion 241 which may be in contact with the main body 10 when the internal door 33 is closed, a body portion 243 which may be linearly moved forward and backward according to whether the internal door 33 is opened or closed so as to elastically deform the elastic portion 223 of the locking part 220, and a spring coupling portion 245 to which the spring 250 may be coupled.

In the operation bar 240, if the internal door 33 is closed, the head portion 241 may be in contact with the main body 10 and may be linearly moved forward in the receiving groove 231 of the housing 230. While the operation bar 240 is moved forward, the body portion 243 may be in contact with the elastic portion 223 of the locking part 220 and may elastically deform the elastic portion 223, and thus the locking hook 221 may be unlocked with the hooking portion 211 of the stopper 210.

At this time, the spring 250 coupled to the operation bar 240 may be compressed and thus a compressed force is stored.

Therefore, in a state in which the internal door 33 is closed, the external door 35 may be freely rotated.

In the operation bar 240, if the internal door 33 is opened, the head portion 241 may be released from the contact with the main body 10 and may be linearly moved backward by the spring 250 having the compressed force. While the operation bar 240 is moved backward, the body portion 243 may be released from the contact with the elastic portion 223 of the locking part 220, and the elastic portion 223 may be restored to its original shape, and thus the locking hook 221 may be locked with the hooking portion 211 of the stopper 210.

Therefore, when the internal door 33 is opened, the external door 35 may be restricted by the internal door 33 so as not to be freely rotated.

One end of the spring 250 may be coupled to the spring coupling portion 245 of the operation bar 240, and the other end may be supported by the spring supporting portion 233 of the housing 230.

When the internal door 33 is closed, the spring 250 may be in contact with the main body 10 and may be compressed by the operation bar 240 which may be linearly moved forward, and thus the compressed force may be stored. When the internal door 33 is opened, the spring 250 may enable the operation bar 240 released from the contact with the main body 10 to be linearly moved backward by the stored compressed force.

An operation of the external door opening prevention device which allows or prevents the opening of the external door according to whether the internal door is opened or closed will be described with reference to FIGS. 12 and 14 to 16.

Figure 14:
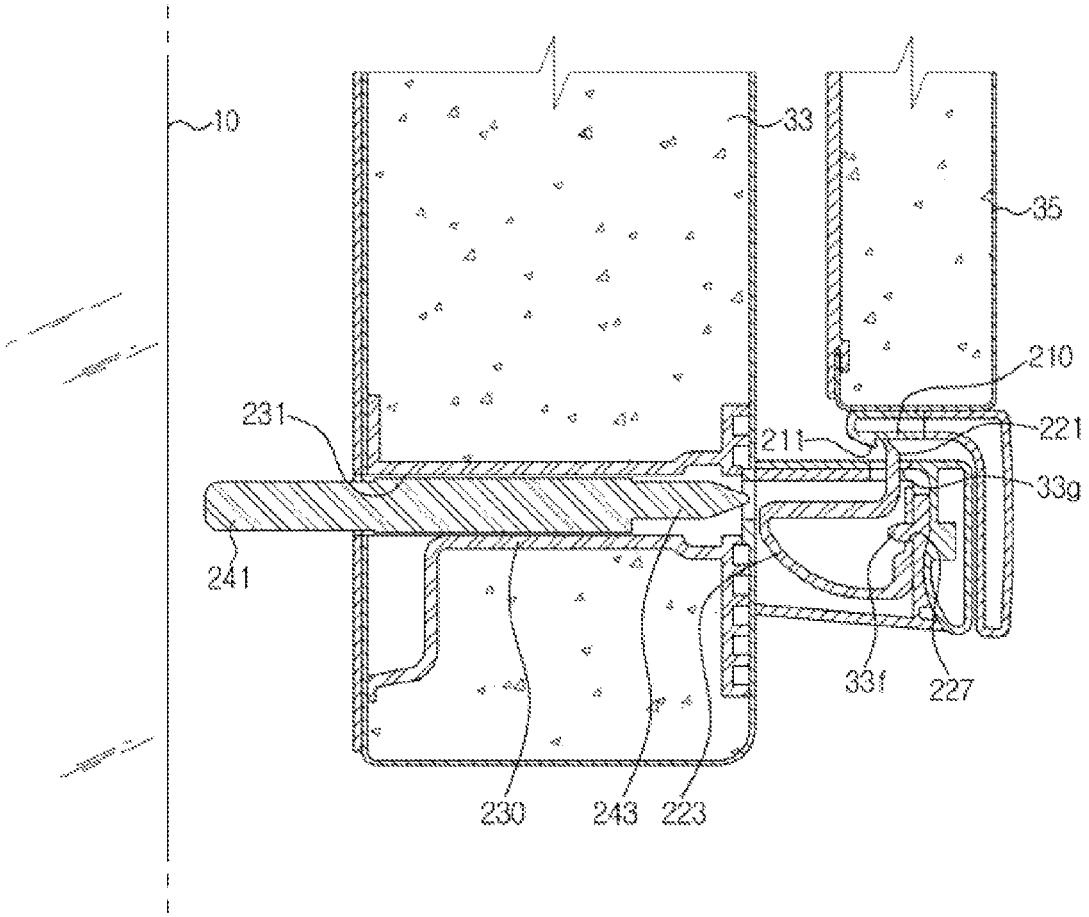
FIG. 14 is a view illustrating a state in which an internal door of a refrigerator is opened in accordance with one or more embodiment.

First of all, as illustrated in FIG. 14, in the state in which the internal door 33 is opened, the body portion 243 of the operation bar 240 may not be in contact with the elastic portion 223 of the locking part 220, and thus the locking hook 221 may be locked with the hooking portion 211 of the stopper 210, and the external door 35 may be fixed to the internal door 33 so as not to be freely rotated.

Figure 15:
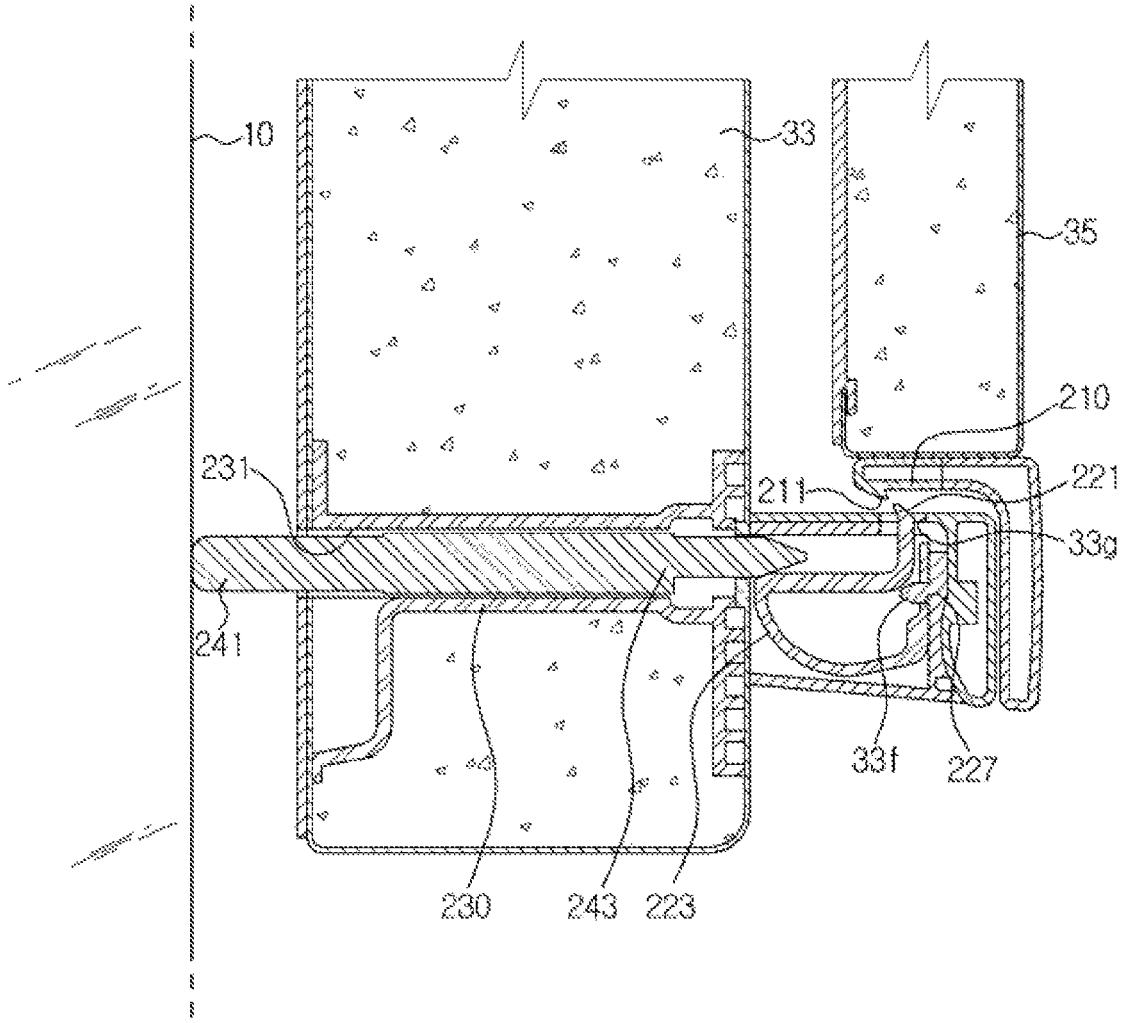
FIG. 15 is a view illustrating a state in which an internal door of a refrigerator is being closed in accordance with one or more embodiment.

As illustrated in FIG. 15, if the internal door 33 is closed, the head portion 241 of the operation bar 240 may be in contact with the main body 10, and the operation bar 240 may be linearly moved forward.

If the operation bar 240 is linearly moved forward, the body portion 243 may be in contact with the elastic portion 223 of the locking part 220, and the elastic portion 223 may be elastically deformed.

Figure 12:
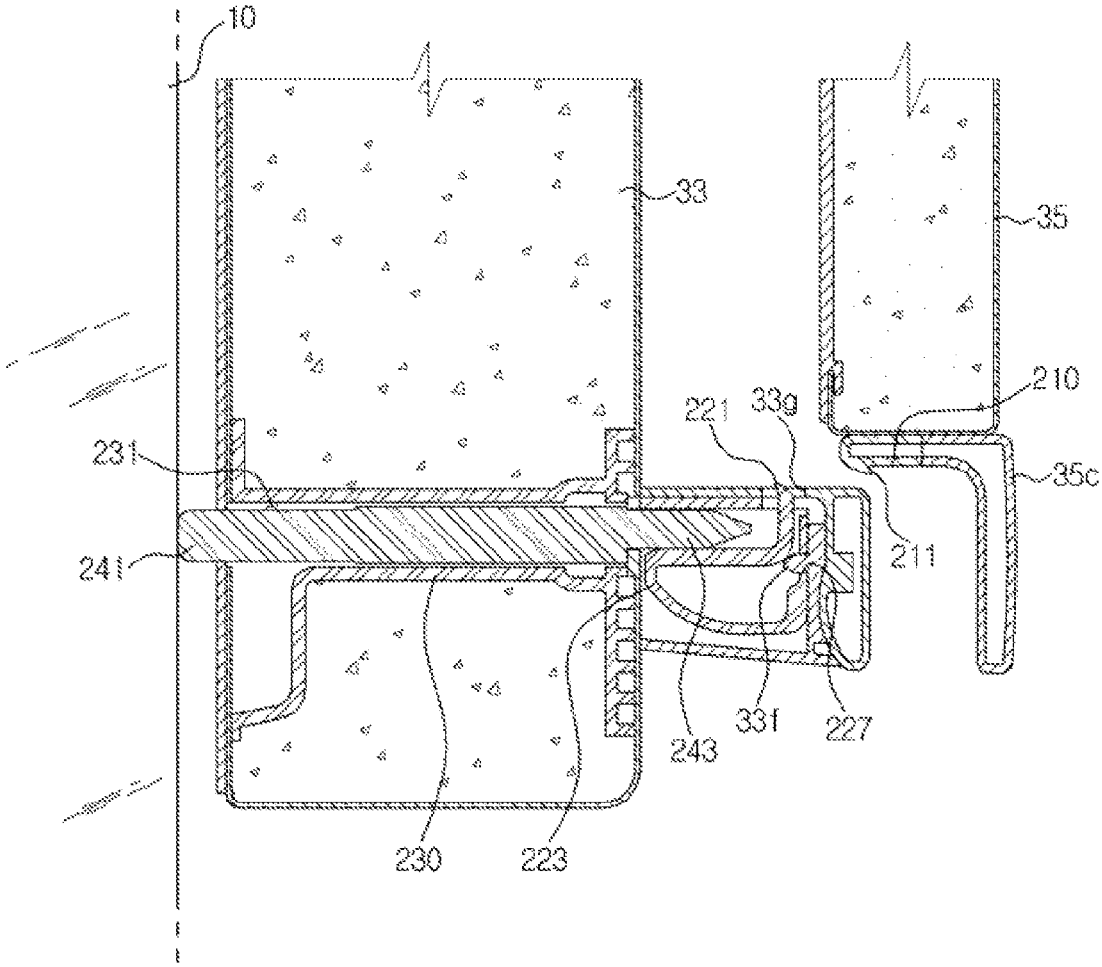
FIG. 12 is a view illustrating a state in which an external door of a refrigerator is opened while an internal door of the refrigerator is closed in accordance with one or more embodiment.
Figure 13:
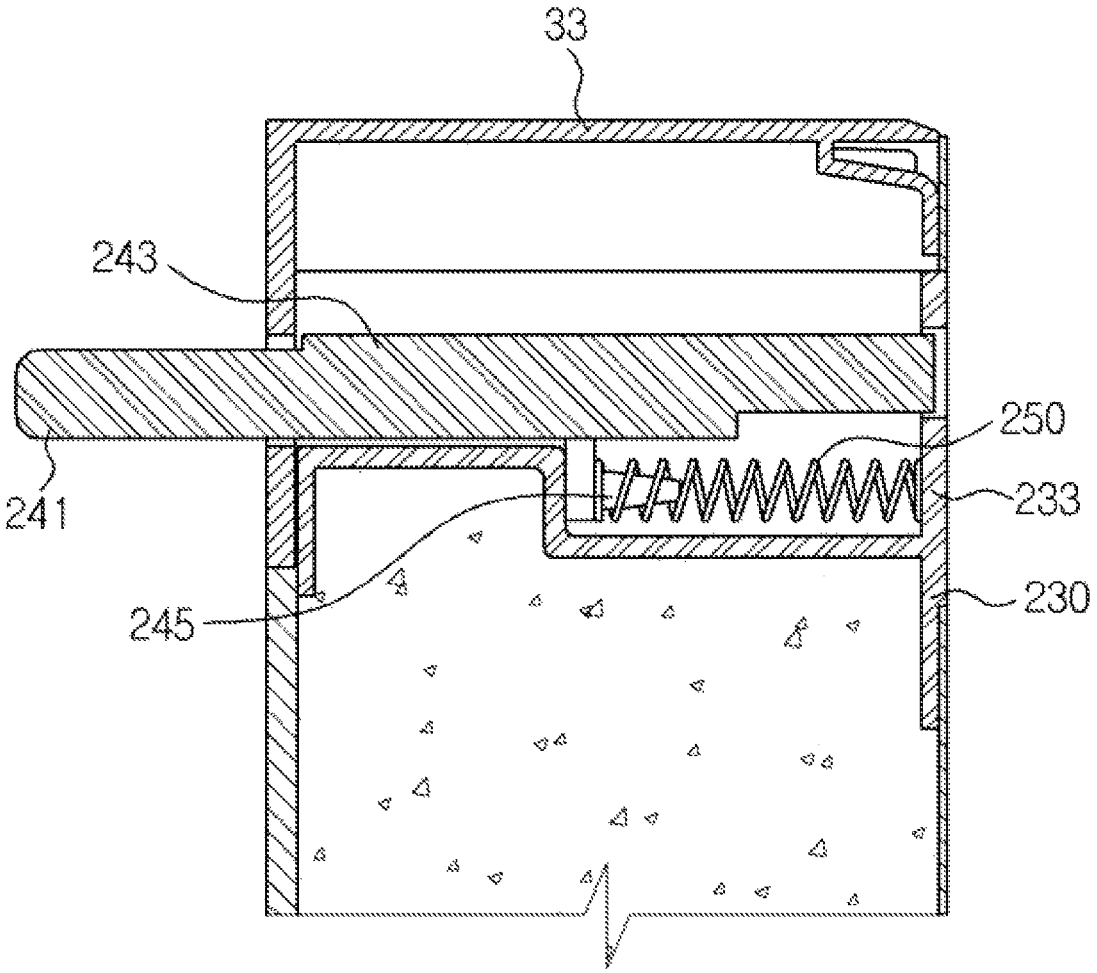
FIG. 13 is a view illustrating a state in which a spring is coupled to an operation bar of an external door opening prevention device in accordance with one or more embodiment.
Figure 16:
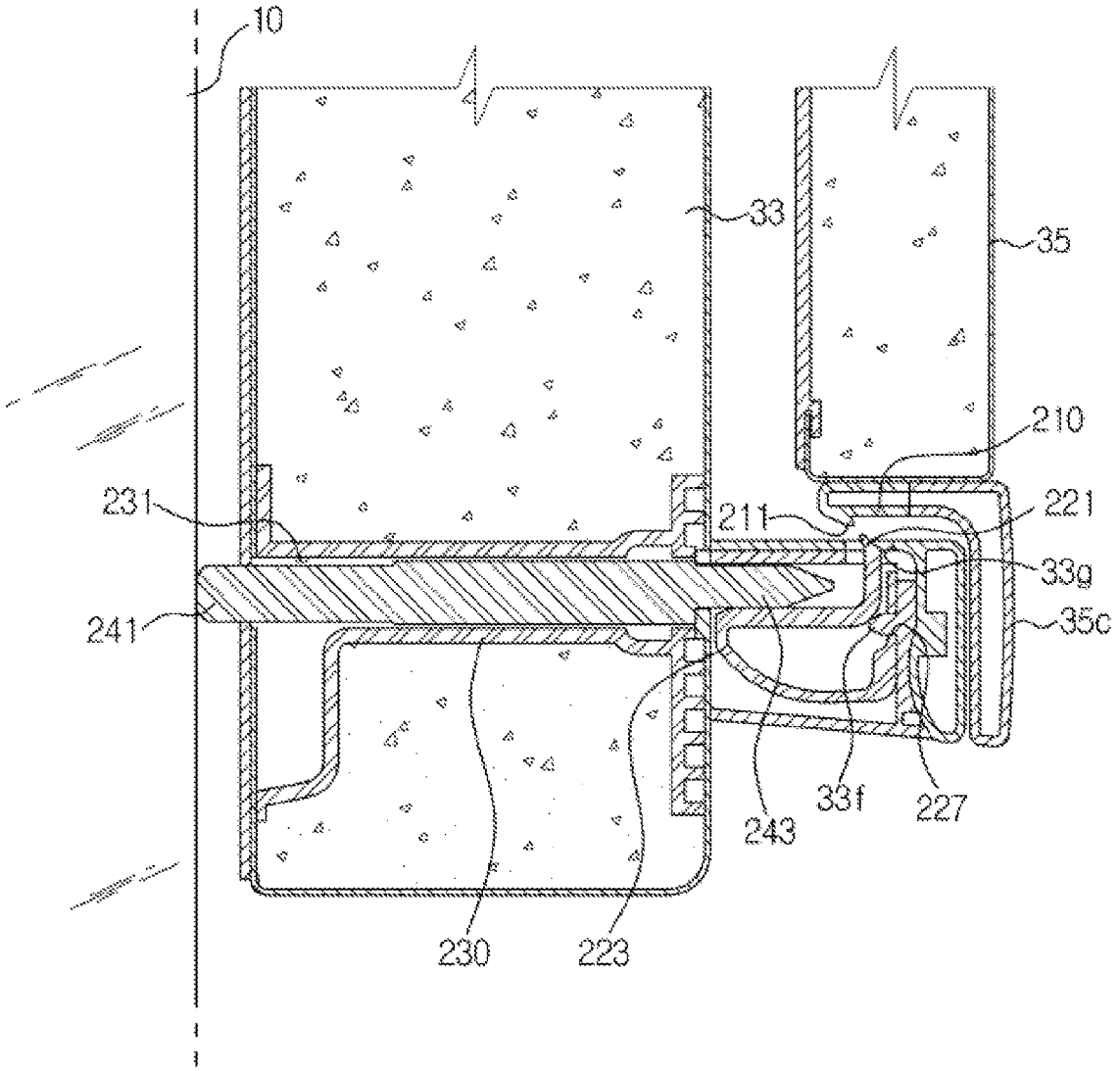
FIG. 16 is a view illustrating a state in which an internal door of a refrigerator is closed and an external door may be freely rotated in accordance with one or more embodiment.

As illustrated in FIG. 16, while the elastic portion 223 is elastically deformed, the locking hook 221 provided at one side of the elastic portion 223 may be unlocked with the hooking portion 211 of the stopper 210, and the external door 35 may be in a state in which it can be freely rotated, and thus the external door 35 may be opened, as illustrated in FIG. 12.

At this time, the spring 250 may be compressed by the operation bar 240 which may be linearly moved forward.

If the internal door 33 is opened in the closed state, the head portion 241 of the operation bar 240 may be released from the contact with the main body 10, as illustrated in FIG. 14, and the operation bar 240 may be linearly moved backward by the spring 250 having the stored compressed force.

If the operation bar 240 is linearly moved backward, the body portion 243 may be linearly moved backward and released from the contact with the elastic portion 223, and the elastic portion 223 may be restored to its original shape, and thus the locking hook 221 may be locked again with the hooking portion 211 of the stopper 210.

According to one or more embodiment, it may be possible to prevent the internal door from being opened together by the inertial force when the external door is opened, and also to prevent the external door from being opened together by the inertial force when the internal door is opened.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A refrigerator comprising:

a main body;

a storage chamber provided in the main body so that a front surface thereof is open;

an internal door rotatably provided at the front surface of the main body so as to open and close the storage chamber and having an opening part in which a plurality of door guards are provided;

an external door rotatably provided at a front surface of the internal door so as to open and close the opening part; and an internal door opening prevention device to allow or prevent opening of the internal door according to whether the external door is opened or closed, wherein the internal door opening prevention device comprises a stopper coupled to a lower portion of the main body;

a locking part rotatably coupled to a lower portion of the internal door and rotated according to whether the external door is opened or closed so as to be locked and unlocked with the stopper;

a spring configured to elastically support the locking part;

a cover configured to cover the locking part so as to prevent the locking part from being exposed to an outside and having a rotational protrusion to which the locking part is rotatably coupled; and a protruding part coupled to a lower portion of the external door, the protruding part being configured to be in contact with the locking part and thus to rotate the locking part to be unlocked from the stopper when the external door is in a closed position, wherein when the external door is in an open position, the protruding part is configured to not be in contact with the locking part whereby the locking part is elastically rotated by the spring to be locked to the stopper.

2. The refrigerator according to claim 1, wherein the locking part is rotatably coupled to the lower portion of the internal door by the rotational protrusion, and comprises:

a rotational hole into which the rotational protrusion is inserted;

a contact portion which is in contact with the protruding part;

a locking hook which is rotated according to whether the external door is opened or closed and locked and unlocked with the stopper; and a spring coupling portion to which the spring is coupled.

3. The refrigerator according to claim 2, wherein the stopper comprises a hook which has a shape corresponding to the locking hook so that the locking hook is locked and unlocked according to the rotation of the locking hook.

4. The refrigerator according to claim 3, wherein parts of front and rear surfaces of the cover are opened so that the locking part is rotated forward and backward around the rotational protrusion, and the cover comprises a spring supporting portion supporting one end of the spring, an other end of the spring being coupled to the spring coupling portion.

5. The refrigerator according to claim 4, wherein, when the external door is closed, the protruding part is in contact with the contact part so that the locking part is rotated around the rotational protrusion in a counterclockwise direction, and when the locking part is rotated around the rotational protrusion in the counterclockwise direction, the locking hook is unlocked with the stopper and the internal door is allowed to be opened.

6. The refrigerator according to claim 5, wherein, when the external door is opened, the protruding part is released from contact with the contact part, and the locking part is rotated around the rotational protrusion by the spring in a clockwise direction, and when the locking part is rotated around the rotational protrusion in the clockwise direction, the locking hook is locked with the stopper and the internal door is prevented from being opened.

7. The refrigerator according to claim 1, wherein the internal door opening prevention device is configured to allow the internal door to be opened with respect to the main body when the external door is closed with respect to the internal door, and to prevent the internal door from being opened with respect to the main body when the external door is opened with respect to the internal door.

8. The refrigerator according to claim 1, wherein the stopper and the cover are respectively coupled to the lower portion of the main body and the lower portion of the internal door by fastening members.

9. A refrigerator comprising:

a main body having a storage chamber;

an internal door rotatably provided at a front surface of the main body so as to open and close the storage chamber and having an opening part in which a plurality of door guards are provided;

an external door rotatably provided at a front surface of the internal door so as to open and close the opening part; and an internal door opening prevention device to allow or prevent opening of the internal door according to whether the external door is opened or closed, wherein the internal door opening prevention device comprises a stopper coupled to a lower portion of the main body;

a locking part rotatably coupled to a lower portion of the internal door and rotated according to whether the external door is opened or closed so as to be locked and unlocked with the stopper;

a spring coupled to the locking part; and a protruding part coupled to a lower portion of the external door, the protruding part being configured to be in contact with the locking part and thus to rotate the locking part to be unlocked from the stopper when the external door is in a closed position, wherein when the external door is in an open position, the protruding part is configured to not be in contact with the locking part whereby the locking part is elastically rotated by the spring to be locked to the stopper.

10. The refrigerator according to claim 9, wherein the internal door opening prevention device further comprises a cover having a rotational protrusion to which the locking part is rotatably coupled.

11. The refrigerator according to claim 10, wherein the locking part is rotatably coupled to the lower portion of the internal door by the rotational protrusion, and comprises:

a rotational hole into which the rotational protrusion is inserted;

a contact portion which is in contact with the protruding part;

a locking hook which is rotated according to whether the external door is opened or closed and locked and unlocked with the stopper; and a spring coupling portion to which the spring is coupled.

12. The refrigerator according to claim 11, wherein the stopper comprises a hook which has a shape corresponding to the locking hook so that the locking hook is locked and unlocked.

13. The refrigerator according to claim 12, wherein parts of front and rear surfaces of the cover are opened so that the locking part is rotated forward and backward around the rotational protrusion, and the cover comprises a spring supporting portion supporting one end of the spring, the other end of which is coupled to the spring coupling portion.

14. The refrigerator according to claim 13, wherein the stopper and the cover are respectively coupled to the lower portion of the main body and the lower portion of the internal door by fastening members.

* * * * *